US007291258B2

(12) United States Patent
Podrebarac et al.

(10) Patent No.: US 7,291,258 B2
(45) Date of Patent: Nov. 6, 2007

(54) HDS PROCESS USING SELECTED NAPHTHA STREAMS

(75) Inventors: Gary G. Podrebarac, Houston, TX (US); Mario J. Maraschino, Houston, TX (US); Montri Vichailak, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 121 days.

(21) Appl. No.: 11/271,229

(22) Filed: Nov. 12, 2005

(65) Prior Publication Data

US 2006/0065578 A1 Mar. 30, 2006

Related U.S. Application Data

(63) Continuation of application No. 10/463,959, filed on Jun. 18, 2003, now abandoned.

(60) Provisional application No. 60/438,361, filed on Jan. 7, 2003.

(51) Int. Cl.
*C10G 45/02* (2006.01)

(52) U.S. Cl. ..... 208/213; 208/216 R; 208/217; 208/218; 208/212; 208/189; 203/DIG. 6

(58) Field of Classification Search ..... None
See application file for complete search history.

(56) References Cited

U.S. PATENT DOCUMENTS

| | | | | |
|---|---|---|---|---|
| 4,265,735 | A | 5/1981 | Audeh et al. | 208/234 |
| 5,169,516 | A | 12/1992 | Carr | 208/189 |
| 5,320,742 | A | 6/1994 | Fletcher et al. | 208/89 |
| 5,510,089 | A | 4/1996 | Jones | 422/189 |
| 5,597,476 | A | 1/1997 | Hearn et al. | 208/208 |
| 5,659,106 | A | 8/1997 | Frey et al. | 585/803 |
| 5,759,386 | A | 6/1998 | Frey | 208/217 |
| 5,779,883 | A | 7/1998 | Hearn et al. | 208/213 |
| 5,807,477 | A | 9/1998 | Hearn et al. | 208/238 |
| 5,851,383 | A | 12/1998 | Frey | 208/217 |
| 6,083,378 | A | 7/2000 | Gildert et al. | 208/209 |
| 6,231,752 | B1 | 5/2001 | Putman | 208/213 |
| 6,416,658 | B1 | 7/2002 | Maraschino et al. | 208/189 |
| 6,444,118 | B1 | 9/2002 | Podrebarac et al. | 208/210 |
| 6,495,030 | B1 | 12/2002 | Podrebarac | 208/218 |

FOREIGN PATENT DOCUMENTS

EP 0 725 126 A1 8/1996

*Primary Examiner*—Tam M. Nguyen
(74) *Attorney, Agent, or Firm*—Osha Liang LLP

(57) ABSTRACT

A process for concurrently fractionating and hydrotreating a full range naphtha stream. The full boiling range naphtha stream is subjected to simultaneous hydrodesulfurization and splitting into a light boiling range naphtha and a heavy boiling range naphtha, which have been treated to convert mercaptans in the fractions to $H_2S$, which is separated with and separated from the light naphtha which is further hydrodesulfurized by contacting the light boiling range naphtha with hydrogen in countercurrent flow in a fixed bed of hydrodesulfurization catalyst to remove recombinant mercaptans which are formed by the reverse reaction of $H_2S$ with olefins in the naphtha during the initial hydrodesulfurization wherein the improvement comprises fractionating said portion of light boiling range naphtha to remove a lighter fraction thereof from said countercurrent flow reactor before contact of said lighter fraction with said fixed bed catalyst, because the lighter fraction is substantially free of mercaptans and is not benefitted by further treatment.

11 Claims, 1 Drawing Sheet

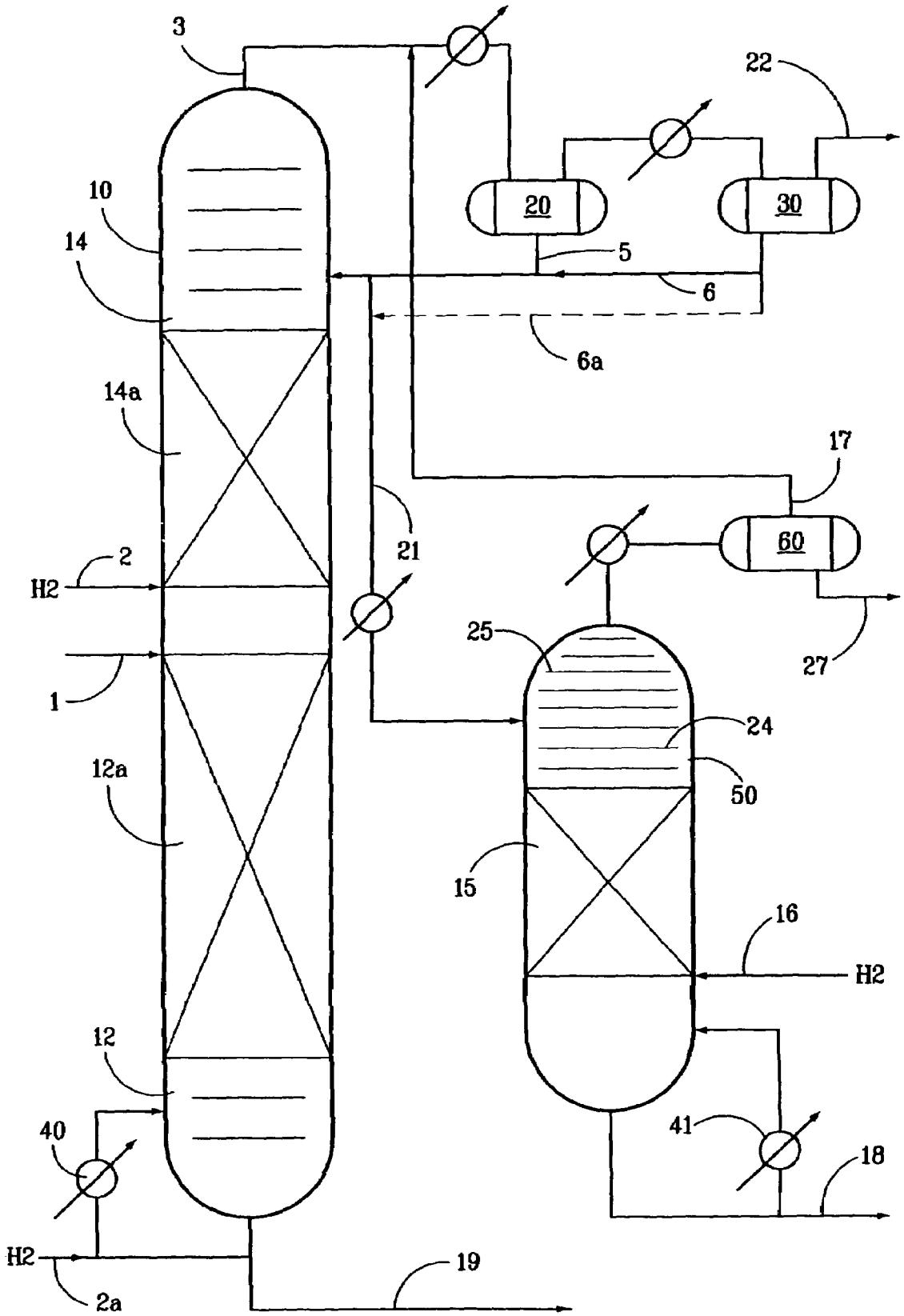
3
22
10
20
30
14
5
6
6a
14a
17
21
60
2
H2
25
27
1
24
12a
50
15
16
H2
12
40
41
18
H2
19
2a

HDS PROCESS USING SELECTED NAPHTHA STREAMS

This is a continuation of Ser. No. 10/463,959, filed on Jun. 18, 2003, now abandoned, which claims the benefit of U.S. Provisional Application No. 60/438,361, filed Jan. 7, 2003

BACKGROUND OF THE INVENTION

1. Field of the Invention

The present invention relates to a process for concurrently fractionating and hydrotreating a full range naphtha stream. More particularly a selected boiling range naphtha stream is subjected to simultaneous hydrodesulfurization and splitting into a light boiling range naphtha and a heavy boiling range naphtha and thereafter polishing the light fraction or the recombined light and heavy fraction in a manner to prevent or reduce recombinant mercaptans.

2. Related Information

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycyclic compounds. The higher sulfur content crudes tend to be naphthenic. Treatment of the different straight run naphthas may be slightly different depending upon their composition due to crude source.

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane. Such cracked-steam sources such as from FCC, coker, visbreaker (and the like) typically contain around 90% of all of the "destination sulfur" that would have reported to refinery gasoline in the absence of all desulfurization treatment.

Catalytically cracked naphtha gasoline boiling range material currently forms a significant part (~⅓) of the gasoline product pool in the United States and it provides the largest portion of the sulfur. The sulfur impurities require removal, usually by hydrotreating, in order to comply with product specifications or to ensure compliance with environmental regulations.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow 2RH+2NH_3 \quad (3)$$

$$ROOH+2H_2 \rightarrow RH+2H_2O \quad (4)$$

Typical operating conditions for naphtha HDS reactions are:

| | |
|---|---|
| Temperature, ° F. | 450-650 |
| Pressure, psig | 250-750 |
| $H_2$ recycle rate, SCF/bbl | 700-2000 |
| Fresh $H_2$ makeup, SCF/bbl | 150-500 |

After the hydrotreating is complete, the product may be fractionated or simply flashed to release the hydrogen sulfide and collect the now desulfurized naphtha.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction, thereby reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250-475° F.

The predominant light or lower boiling sulfur compounds are mercaptans (RSH)while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

In addition to treating the lighter portion of the naphtha to remove the mercaptans, it has been traditional to use the light portion as feed to a catalytic reforming unit to increase the octane number if necessary. Also the lighter fraction may be subjected to further separation to remove the valuable $C_5$ olefins (amylenes) which are useful in preparing ethers.

U.S. Pat. No. 6,083,378 discloses a naphtha splitter as a distillation column reactor to treat a portion or all of the naphtha to remove the organic sulfur compounds contained therein. The catalyst is placed in the distillation column reactor such that the selected portion of the naphtha is contacted with the catalyst and treated. The catalyst may be placed in the rectification section to treat the lighter boiling range components only, in the stripping section to treat the heavier boiling range components only, or throughout the column to widely treat the naphtha. In addition the distillation column reactor may be combined with standard single pass fixed bed reactors or another distillation column reactor to fine tune the treatment.

In hydrodesulfurizations it is known that $H_2S$ can recombine to form mercaptans thus increasing the amount of sulfur in the product. In U.S. Pat. No. 6,416,658 a full boiling range naphtha stream is subjected to simultaneous hydrodesulfurization and splitting into a light boiling range naphtha and a heavy boiling range naphtha followed by a further hydrodesulfurization by contacting the light boiling range naphtha with hydrogen in countercurrent flow in a fixed bed of hydrodesulfurization catalyst to remove recombinant mercaptans which are formed by the reverse reaction of $H_2S$ with olefins in the naphtha during the initial hydrodesulfurization. In particular the entire recovered portion of the light naphtha from a reaction distillation column hydrodesulfurization is further contacted with hydrogen in countercurrent flow in a fixed bed of hydrodesulfurization catalyst.

However, it has been found that the lighter portion of the recovered light naphtha is virtually free of mercaptans and it is not necessary to further treat this fraction. It has been discovered that by fractionating the recovered light portion to remove a specific lighter portion of the light boiling range naphtha which is substantially free of mercaptans, the load on the countercurrent catalyst bed is reduced, therefore allowing a smaller catalyst bed, while still providing hydrodesulfurization treatment for that portion of the light boiling naphtha with the recombinant mercaptans.

It is an advantage of the present invention that the sulfur may be removed from the light and/or heavy naphtha portions of the stream without any substantial loss of olefins. Thus, reduced levels of sulfur may be obtained in the selected fraction and/or the entire stream with reduced costs.

SUMMARY OF THE INVENTION

Briefly the present invention is an improvement in a catalytic distillation hydrodesulfurization process comprising:

(a) feeding a naphtha boiling range hydrocarbon stream containing organic sulfur compounds and hydrogen to a distillation column reactor;

(b) concurrently in said distillation column reactor (i) separating said naphtha into a light boiling range naphtha and a heavy boiling range naphtha (ii) contacting said naphtha and hydrogen with a hydrodesulfurization catalyst to selectively react the organic sulfur compounds therein with said hydrogen to form $H_2S$;

(c) recovering a portion of said light boiling range naphtha wherein said light boiling range naphtha contains recombinant mercaptans;

(d) removing said heavier boiling range naphtha from said distillation column reactor, e.g. as bottoms; and (e) passing said portion of said light boiling range naphtha to a countercurrent flow reactor for contact with hydrogen in fixed bed hydrodesulfurization catalyst to reduce the recombinant mercaptans therein;

wherein the improvement comprises fractionating said portion of light boiling range naphtha to remove a lighter fraction thereof, said lighter fraction being substantially free of mercaptans, from said countercurrent flow reactor before contact of said lighter fraction with said fixed bed catalyst. The fixed catalyst bed may be conventional or alternatively in the form of a catalytic distillation structure.

Both the light naphtha fraction and the heavy naphtha fraction are preferably hydrodesulfurized in a catalytic distillation step. The $H_2S$ produced in the catalytic distillation is removed with the light naphtha fraction, and separated therefrom. Thus, it is in the light naphtha fraction that the recombinant mercaptans are most likely to form, because the $H_2S$ will be in contact with that fraction during its recovery.

In the counterflow operation the newly released $H_2S$ at a given location is unavailable to react again with olefins in the lower sections of the column to form another mercaptan. Hence, there is substantially no $H_2S$ arriving in the bottom of the column and therefore there is no equilibrium limitation on the mercaptan removal. Furthermore, since the lighter fraction which will exit with the $H_2S$, contacts the $H_2S$ in the absence of a catalyst there is substantially no reverse reaction with the olefins in that fraction to form recombinant mercaptans.

The light gasoline that is removed from the countercurrent flow HDS unit without contacting the fixed bed of catalyst is represented as a fraction in the boiling range of initial point through endpoint equal to initial point $\mp 20°$ F. for the overheads from the reaction distillation column. This fraction is substantially mercaptan free. The entire fraction or a portion thereof may be removed to obtain a benefit as described. An advantage of the present invention is that the countercurrent flow reactor generally treats less, preferably less than about 55%, of the overheads from the catalytic distillation HDS, rather than 80-100% previously used. The present improvement allows the use of moderate pressures, preferably 100-270 psig, in the countercurrent flow HDS reactor to obtain temperatures sufficient for HDS and the use of less catalyst.

"Recombinant mercaptans" as that term is used herein means those mercaptans which are not in the feed to the present process but are the reaction products of the $H_2S$ generated by the hydrogenation of the present process and alkenes in the feed. Thus, the recombinant mercaptans are not necessarily the same as those destroyed by the hydrogenation of first portion of the present process, although they may be. The present catalytic distillation hydrogenation is considered to dissociate substantially all of the mercaptans in the feed and the small amounts of mercaptans observed in the product streams are in fact recombinant mercaptans. Although the catalytic distillation reaction is superior to the prior art straight hydrogenation for removing mercaptans, the dynamic system of a catalytic distillation allows sufficient time for some undesirable recombination reaction to occur. Thus, in the present invention the combination of a less efficient countercurrent, straight pass hydrodesulfurization is sufficient to dissociate the small quantities of recombinant mercaptans by having only a limited contact of the produced $H_2S$ before it is removed from the reaction zone.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure. The term "reactive distillation" is used to describe the concurrent reaction and fractionation in a column. For the purposes of the present invention, the term "catalytic distillation" includes reactive distillation and any other process of concurrent reaction and fractional distillation in a column regardless of the designation applied thereto.

BRIEF DESCRIPTION OF THE DRAWING

The FIGURE is a schematic representation of one embodiment of the invention having catalyst beds in a distillation column/naphtha splitter which are used to treat both the light and heavy fraction to hydrogenate and remove mercaptans by reactive distillation in which the overhead light fraction is recovered and sent to a separate fixed bed countercurrent flow polishing reactor.

DETAILED DESCRIPTION OF THE INVENTION

The feed to the process comprises a sulfur-containing petroleum fraction which boils in the gasoline boiling range. Feeds of this type include light naphthas having a boiling range of about $C_5$ to 330° F. and full range naphthas having a boiling range of $C_5$ to 400° F. end point to as high as, e.g. 470° F. end point. Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135-140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes, sulfides and disulfides.

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

Catalysts which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures. However, in the countercurrent fixed-bed polishing reactor, such shapes are directly useful when loaded at optimal particle size which would be slightly larger than those typically encountered in conventional concurrent trickle bed reactor technology. Alternatively, catalyst may be packaged in a suitable catalytic distillation structure which characteristically can accommodate a wide range of typically manufactured fixed-bed catalyst sizes.

The catalysts contain components from Group V, VIB, VIII metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams and hydrogen.

The catalyst may also catalyze the hydrogenation of the olefins and polyolefins contained within the light cracked naphtha and to a lesser degree the isomerization of some of the mono-olefins. The hydrogenation, especially of the mono-olefins in the lighter fraction may not be desirable.

If at the temperature of use in the present process, the ratio of the partial pressures of $H_2S/(H_2S+H_2)$ falls below a temperature-dependent critical value, then desulfiding of the catalyst is likely to occur. Desulfiding is not a harmless event, because the mixed catalysts are typically formulated to yield optimally formed metal clusters on the alumina substrate. Typically, one of the two metals will form base clusters on the alumina support, and the second metal will tend to decorate the first metal along the edges of those clusters. The process of desulfiding a catalyst and then subsequently resulfiding that catalyst is not an identically reversible process. Catalyst mishandled in this way will usually suffer noticeable activity loss and selectivity loss. By selectivity loss, is meant that more olefin loss and more octane-number loss will be registered at a given level of total-sulfur conversion after a desulfiding incident when compared with earlier performance. The desulfiding is most likely to occur in the lower portion of the catalyst bed that would be $H_2S$ deprived compared to other portions of the catalyst beds where $H_2S$ is produced by the decomposition of the mercaptans. The desulfiding of the catalyst may be reduced by introducing $H_2S$ into the catalytic distillation column and/or the polishing column, for example with the hydrogen feed in an amount sufficient to maintain the catalyst.

The catalytic distillation step is carried out at a temperature in the range of 400 to 800° F. at 50 to 400 psig pressure with hydrogen partial pressure in the range of 0.1 to 100 psi at 20 to 1200 scf/bbl at WHSV in the range of 0.1 to 10 $hr^{-1}$ based on feed rate and particulate catalyst packaged in structures. If advanced specialty catalytic structures are used (where catalyst is one with the structure rather than a form of packaged pellets to be held in place by structure). The LHSV for such systems should be about in the same range as those of granular-based catalytic distillation catalyst systems as just referenced.

In the present countercurrent flow reaction the temperature is generally in the range of 400 to 550° F. at 90 to 280 psig pressure. The hydrogen partial pressure is generally in the range of 7 to 250 psi. The hydrogen is fed below the catalyst bed at 50 to 250 scf/bbl. The light naphtha is fed in such that the rate of bottoms draw to catalyst corresponds to a WHSV in the range of 3-15 $hr^{-1}$. The catalyst may be the same as that used in the catalytic distillation structure and it may be utilized in such a structure, although it is not necessary to do so. Generally catalytic particles are ⅛"-½"

dimension to facilitate favorable mass flow and favorable fluid-to-particle mass transfer characteristics.

Preferably there is a stripper section above the catalyst bed in the fixed bed countercurrent reactor. This provides for removal of additional dissolved $H_2S$ and the lighter fraction from the catalytic distillation column. For example, in order to reduce recombinant in a feed containing mercaptans 252 ppm $H_2S$ to 2-5 ppm in the effluent from the counterflow trickle bed reactor which is operated at 215 psig, 400° F., WHSV of 8 $hr^{-1}$, in a 7 foot bed of Co/Mo, ¼" catalyst, a stripper zone of 6-12 theoretical stage is required above the catalyst bed. This arrangement reduces the light overheads contacting the fixed bed from about 25-40% and reduces the dissolved $H_2S$ in the reaction zone, e.g., 5-10 ppm, hence reducing the recombinant mercaptans to negligible levels.

The concentration of $H_2S$ necessary to avoid desulfiding the metals on the catalyst is quite small. So long as the required amount of $H_2S$ relative to flowing hydrogen is equaled or exceeded everywhere in the vapor exposed to the bed, the catalyst will not desulfide. Also, as temperature is increased, the amount of $H_2S$ relative to hydrogen present that is necessary to achieve this control will increase as well.

The properties of a typical hydrodesulfurization catalyst are shown in Table I below.

TABLE I

| | |
|---|---|
| Manufacture | Criterion Catalyst Co. |
| Designation | C-448 |
| Form | Tri-lobe Extrudate |
| Nominal size | 1.2 mm diameter |
| **Metal,** | **Wt. %** |
| Cobalt | 2-5% |
| Molybdenum | 5-20% |
| Support | Alumina |

The catalyst typically is in the form of extrudates having a diameter of ⅛, 1/16 or 1/32 inches and an LD of 1.5 to 10. The catalyst also may be in the form of spheres having the same diameters. They may be directly loaded into standard single pass fixed bed reactors which include supports and reactant distribution structures. However, in their regular form they form too compact a mass for operation in the catalytic distillation hydrodesulfurization tower and must then be prepared in the form of a catalytic distillation structure. (However, in the polishing reactor, extrudates are perfectly acceptable if the size range is in the ⅛, ¼, ⅜, ½ inch ranges. Typically particles used in countercurrent fixed bed operation are roughly twice the average diameter of those used in corresponding concurrent fixed bed reactors). The catalytic distillation structure must be able to function as catalyst and as mass transfer medium. The catalyst must be suitably supported and spaced within the column to act as a catalytic distillation structure. In a preferred embodiment the catalyst is contained in a structure as disclosed in U.S. Pat. No. 5,730,843, which is hereby incorporated by reference. More preferably the catalyst is contained in a plurality of wire mesh tubes closed at either end and laid across a sheet of wire mesh fabric such as demister wire. The sheet and tubes are then rolled into a bale for loading into the distillation column reactor. This embodiment is described in U.S. Pat. No. 5,431,890 which is hereby incorporated by reference. Other catalytic distillation structures useful for this purpose are disclosed in U.S. Pat. Nos. 4,731,229, 5,073,236, 5,431,890 and 5,266,546 which are also incorporated by reference.

Reaction conditions for sulfur removal only in a standard single pass fixed bed reactor are in the range of 500-700° F. at pressures of between 400-1000 psig. Residence times expressed as liquid hourly space velocity are generally typically between 1.0 and 10. The naphtha in the single pass fixed bed reaction may be in the liquid phase or gaseous phase depending on the temperature and pressure, with total pressure and hydrogen gas rate adjusted to attain hydrogen partial pressures in the 100-600 psia range. The operation of the single pass fixed bed hydrodesulfurization is otherwise well known in the art.

The conditions suitable for the desulfurization of naphtha in a distillation column reactor are very different from those in a standard trickle bed reactor, especially with regard to total pressure and hydrogen partial pressure. Typical conditions in a reaction distillation zone of a naphtha hydrodesulfurization distillation column reactor are:

| | |
|---|---|
| Temperature | 450-700° F. |
| Total Pressure | 75-300 psig |
| $H_2$ partial pressure | 6-75 psia |
| WHSV of naphtha | about 1-5 |
| $H_2$ rate | 10-1000 scf/bbl |

The operation of the distillation column reactor results in both a liquid and vapor phase within the distillation reaction zone. A considerable portion of the vapor is hydrogen while a portion is vaporous hydrocarbon from the petroleum fraction.

In the catalytic distillation it has been proposed that the mechanism that produces the effectiveness of the present process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species. The result of the operation of the process in the distillation column reactor is that lower hydrogen partial pressures (and thus lower total pressures) may be used.

As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, no hydrocracking or less saturation of desirable olefinic compounds. The higher boiling portion is subjected to higher temperatures in the lower end of the distillation column reactor to crack open the sulfur containing ring compounds and hydrogenate the sulfur. The heat of reaction simply creates more boil up, but no increase in temperature at a given pressure. As a result, a great deal of control over the rate of reaction and distribution of products can be achieved by regulating the system pressure.

Operating conditions for the present fixed bed countercurrent flow naphtha HDS reactions may be:

| | |
|---|---|
| Temperature, ° F. | 400-550 |
| Pressure, psig | 140-275 |
| $H_2$ recycle rate, SCF/bbl | 70-200 |
| Fresh $H_2$ makeup, SCF/bbl | 25-75 |

In the polishing reactor or section of the present invention, the liquid is downflow and the hydrogen is upflow, thus the stripping action is also present and the very small amounts of recombinant mercaptans are readily reduced to even lower levels. As discussed above, the optimum conditions for the two types of reactions are not in the same range. Since the major hydrodesulfurization is going on in the reactive distillation, the activity of the countercurrent flow straight pass hydrodesulfurization is somewhat compromised, however it is adequate to achieve a sufficient removal of the recombinant mercaptans to meet the objectives of the treatment.

Referring now to the FIGURE the catalyst 12*a* and 14*a* is loaded into the stripping section 12 and the rectification section 14 of a naphtha splitter 10 configured as a distillation column reactor. The naphtha is fed into the distillation column reactor 10 between the sections via flow line 1 and hydrogen is fed below both sections via lines 2 and 2*a*. The light naphtha (comprised of a light ends and a mid light) is boiled up into the rectification section 14 and removed along with unreacted hydrogen and $H_2S$ as overheads via flow line 3. The light naphtha is condensed in condensers 20 and separated from the hydrogen and $H_2S$ and other lights in receiver/separator 30 via flow line 22. The liquid (light naphtha) from the separator 20 and 30 is removed via flow line 5 and 5*a*, respectively and a portion returned to the distillation column reactor as reflux via flow line 6. Alternatively, the flow line 6A may be utilized instead of 6 so that all of the liquid leaving the colder drum 30 is diverted to reactor 50. The recovered liquid portion not returned as reflux is directed to the straight pass countercurrent flow reactor 50, via line 21, where it contacts the hydrogen in the hydrodesulfurization catalyst bed 15. The hydrogen is fed via line 16 below the bed 15. The hydrogen passes upward through the catalyst bed and the downflowing light naphtha where it contacts the recombinant mercaptans and covers a portion to $H_2S$.

The light naphtha has a spread in the range between its End Point and the Initial Point of preferably about 120° F. or less the $H_2S$, and the unreacted hydrogen exit the countercurrent flow reactor 50 to separator 60. The unreacted hydrogen and $H_2S$ exit the separator 60 and pass via line 17 to the separator 20 for treatment with the overhead from the catalytic distillation reactor and the condensed and the condensed light ends are recovered from separator 60 via line 27. A stripping section 24 above the catalyst bed 15, but below the feed 21 to countercurrent polishing reactor 50 is used to keep $H_2S$ in the feed from flow line 21 away from the catalyst bed 15. A rectification section 25 is provided above feed 21 to facilitate the $H_2S$ and light ends removal and to separate the liquids (the mid light) which may be entrained in the upflow gas stream. Mid light naphtha product is recovered via line 18 and heavy naphtha product is recovered via line 19. The catalytic distillation column has a reboiler 40 and the fixed bed reactor 50 may have an optional reboiler 41, which will result in some reflux into the catalyst bed. The upper section of reactor 50 is preferably a multistage contact zone where $H_2S$ dissolved in the incoming light naphtha can be stripped out so that dissolved $H_2S$ is not present in the catalyst zone 15.

The preferred operating conditions and results for the distillation column reactor 10 of the FIGURE are as follows:

| | |
|---|---|
| Pressure, psig | 100-300 |
| $H_2$ rate, scfh | 150-1000 |
| $H_2$ partial pres., psi | 5-75 |
| WHSV | 0.2-10 |
| % HDS | 90-99 |

In the fixed bed reactor 50 of the FIGURE the preferred operating conditions and results are:

| | |
|---|---|
| Pressure, psig | 90-250 |
| $H_2$ rate, scf | 50-250 |
| $H_2$ partial pres., psi | 10-180 |
| WHSV(based on bottom flow) | 3-16 |
| Mercaptans(combined w/stream 21), ppm | <2-10 |

Note that a small recycle compressor (not shown ) may be necessary in line 17, if the countercurrent reactor 50 operates a lower pressure than column 10.

The hydrogen may be recycled back to the reactors. Vents may be sufficient to maintain the $H_2S$ levels low enough for the reaction. However, if desired, the recycle gas may be scrubbed using conventional methods to remove the $H_2S$. The light naphtha recovered in line 27 may be combined with the mid light of line 18 to replicate the overheads 3 from column 10 having reduced total sulfur. Similarly the entire naphtha feed to the process (line 1) may be recreated having reduce total sulfur by combining all three product streams from lines 27, 18 and 19.

The invention claimed is:

1. In a catalytic distillation hydrodesulfurization process comprising:

(a) feeding a naphtha boiling range hydrocarbon stream containing organic sulfur compounds and hydrogen to a distillation column reactor;

(b) concurrently in said distillation column reactor (i) separating said naphtha into a light boiling range naphtha boiling in the range $C_5$ to 330° F. and a heavy boiling range naphtha boiling in the range of about 330° F. and above;

(ii) contacting a fraction of said naphtha and hydrogen with a hydrodesulfurization catalyst to selectively react the organic sulfur compounds therein with said hydrogen to form $H_2S$;

(c) recovering a portion of said light boiling range naphtha wherein said light boiling range naphtha contains recombinant mercaptans;

(d) removing said heavier boiling range naphtha from said distillation column reactor; and (e) passing said portion of said light boiling range naphtha to a countercurrent flow reactor for contact with hydrogen in fixed bed hydrodesulfurization catalyst to reduce the recombinant mercaptans therein;

wherein the improvement comprises fractionating said portion of light boiling range naphtha to remove a lighter fraction thereof, said lighter fraction having a boiling range between its Initial Point and End Point of up to about 120° F. and being substantially free of mercaptans, from said countercurrent flow reactor before contact of said lighter fraction with said fixed bed catalyst.

2. The process according to claim 1 wherein said portion of light boiling naphtha comprises overhead.

3. The process according to claim 1 wherein said portion of light boiling naphtha comprises reflux.

4. The process according to claim 1, wherein said hydrodesulfurization catalyst comprises a metal sulfide.

5. The process according to claim 1, wherein $H_2S$ is added to the hydrogen in at least one of said catalytic distillation column or in said fixed bed in an amount sufficient to maintain the hydrodesulfurization catalyst in an active state.

6. A process for the hydrodesulfurization of naphtha in a distillation column reactor having a stripping section and a rectification section, comprising the steps of:

(a) feeding a naphtha boiling range hydrocarbon stream containing organic sulfur compounds and hydrogen to a distillation column reactor above said stripping section;

(b) concurrently in said distillation column reactor (i) separating said naphtha into a light boiling range naphtha fraction boiling in the range of $C_5$ to about 330° F. and a heavy boiling range naphtha fraction boiling above about 330° F.;

(ii) contacting at least one of said naphtha fractions and hydrogen with a hydrodesulfurization catalyst in said stripping section to selectively react the heavier organic sulfur compounds with said hydrogen to form $H_2S$;

(c) removing said light boiling range naphtha fraction, $H_2S$ and unreacted hydrogen and recombinant mercaptans from said distillation column reactor as overheads;

(d) removing said heavier boiling range naphtha from said distillation column reactor; and (e) fractionating said portion of said light boiling range naphtha to remove a lighter fraction thereof having a boiling range between its Initial Point and End Point of up to about 120° F. and in the range of $C_5$ to about 330° F. and contacting a remaining portion heavier fraction of said light boiling range naphtha with hydrogen in countercurrent flow in a fixed bed of hydrodesulfurization catalyst to reduce the recombinant mercaptans therein.

7. The process according to claim 6 wherein said light boiling naphtha fraction is hydrodesulfurized in (b).

8. The process according to claim 6 wherein said heavy boiling naphtha fraction is hydrodesulfurized in (b).

9. The process according to claim 6 wherein said light boiling naphtha fraction and said heavy boiling fraction are hydrodesulfurized in (b).

10. The process according to claim 6 wherein said hydrodesulfurization catalyst comprises a metal sulfide.

11. The process according to claim 6 wherein $H_2S$ is added to the hydrogen in at least one of said catalytic distillation column or in said fixed bed in an amount sufficient to maintain the hydrodesulfurization catalyst in an active state.

* * * * *